US007217143B2

(12) United States Patent
Yang et al.

(10) Patent No.: US 7,217,143 B2
(45) Date of Patent: May 15, 2007

(54) ELECTRICAL CONNECTOR

(75) Inventors: Xiang Qi Yang, Kunshan (CN); Ren-Chih Li, Taipei (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/338,136

(22) Filed: Jan. 23, 2006

(65) Prior Publication Data

US 2006/0166529 A1 Jul. 27, 2006

(30) Foreign Application Priority Data

Jan. 22, 2005 (CN) ..... 2005 2 0068555

(51) Int. Cl.
*H01R 12/00* (2006.01)

(52) U.S. Cl. ..... 439/83; 439/328

(58) Field of Classification Search ..... 439/83, 439/328

See application file for complete search history.

(56) References Cited

U.S. PATENT DOCUMENTS 6,053,767 A 4/2000 Copper
6,116,922 A * 9/2000 Szu et al. ..... 439/83
6,139,336 A * 10/2000 Olson ..... 439/83
6,817,875 B2 11/2004 Chang

FOREIGN PATENT DOCUMENTS

CN 2660701 Y 12/2004

* cited by examiner

*Primary Examiner*—Tho D. Ta
(74) *Attorney, Agent, or Firm*—Wei Te Chung

(57) ABSTRACT

An electrical connector (7) for surface mounting on a printed circuit board (PCB) includes an insulative housing (1); a number of terminals (5) disposed in the housing and having tails (51) extending beyond the housing, all the tails (51) defining a common mounting plane (52); at least one metallic mounting portion (42) assembled to the housing (1), the at least one metallic mounting portion (42) defining a bottom plane (421) for soldering to the PCB, the bottom plane (421) being located at a level higher than said the mounting plane (52) by a distance; and a solder ball (6) connected to the at least one metallic mounting portion (42), the solder ball (6) being able to be softened to fill said distance during soldering.

20 Claims, 5 Drawing Sheets

ELECTRICAL CONNECTOR

BACKGROUND OF THE INVENTION

1. Field of the Invention

The present invention relates to an electrical connector, and more particularly to an electrical connector for surface mounting on a printed circuit board.

2. Description of Related Art

Generally, a conventional electrical connector for electrically connecting a chipset to a printed circuit board (PCB) is attached to the PCB by soldering terminals thereof to the PCB via Surface Mounting Technology (SMT). Before the electrical connector is attached to the PCB, solder tails of the terminals should be adjusted to perform a wonderful coplanarity so as to ensure that each of the terminals can be reliably soldered to the PCB.

CN. Pat. No. 200320103928.X discloses an electrical connector including a housing with a pair of cantilevered side walls in opposite ends of the housing, a plurality of terminals loaded in the housing and a pair of metallic latches assembled to the housing. Each said latch has a body, which assembled to the side wall, a securing arm downwardly extending from a distal end of the body, a mounting portion formed near a downmost distal end of the securing arm, and a flexing portion joining the securing arm and the mounting portion. The mounting portion includes two slips respectively positioned at frontside and rearside of the flexing portion. There is a cutout defined between the flexing portion and each of the slips. Since the mounting portion is soldered onto the PCB by SMT together with the solder tails of the terminals, it is required that the tails of the terminals and the mounting portion of the latch perform a good coplanarity, or else neither facility nor reliability of soldering operation can't be ensured. However, since the terminals and the latch are formed from different metal sheets and are assembled on the housing separately, it is difficult to ensure a wonderful coplanarity between said tails and said mounting portion. Thus the latches should adjust the position of a solder surface of the mounting portions thereof for gaining a coplanarity with the tails of the terminals. Therefore, the flexing portion should be compressed if the securing arm is too long to perform a coplanarity with the tails of the terminals, or should be drawn out if the securing arm is too short to perform a coplanarity with the tails of the terminals. However, such compression or drawing operation may causes the mounting portion to slant from the PCB, as a result of which the connecting area between the mounting portion and the PCB is reduced and the capability of connecting is weakened. Moreover, the solder tails of terminals are apt to be twisted by an unintentional and improper operation during adjusting of the latches so that some tails of the terminals may be deformed to destroy the coplanarity. Furtheremore, to adjust the mounting portion coplanarity with the solder tails of the terminals after the adjusting of the coplanarity between the tails increases an additional procedure.

Therefore, an improved electrical connector is desired to overcome the disadvantages of the prior arts.

SUMMARY OF THE INVENTION

An object of the present invention is to provide an electrical connector including terminals and mounting portions, wherein solder tails of the terminals can maintenance a good coplanarity, the terminals and the securing portions can both be reliably soldered to a PCB.

In order to achieve above-mentioned object, an electrical connector in accordance with a preferred embodiment of the present invention includes an insulative housing; a plurality of terminals disposed in the housing, a plurality of terminals disposed in the housing and having tails extending beyond the housing, all the tails defining a common mounting plane; at least a metallic mounting portion assembled to the housing, said metallic mounting portion defining a bottom plane for soldering to the PCB, said bottom plane located vertically above said mounting plane with a distance therebetween; and a solder ball connecting to the mounting portion, said solder ball being able to be softened to fill said distance during soldering.

Other objects, advantages and novel features of the present invention will become more apparent from the following detailed description of the present embodiment when taken in conjunction with the accompanying drawings.

DETAILED DESCRIPTION OF THE INVENTION

Figure 1:
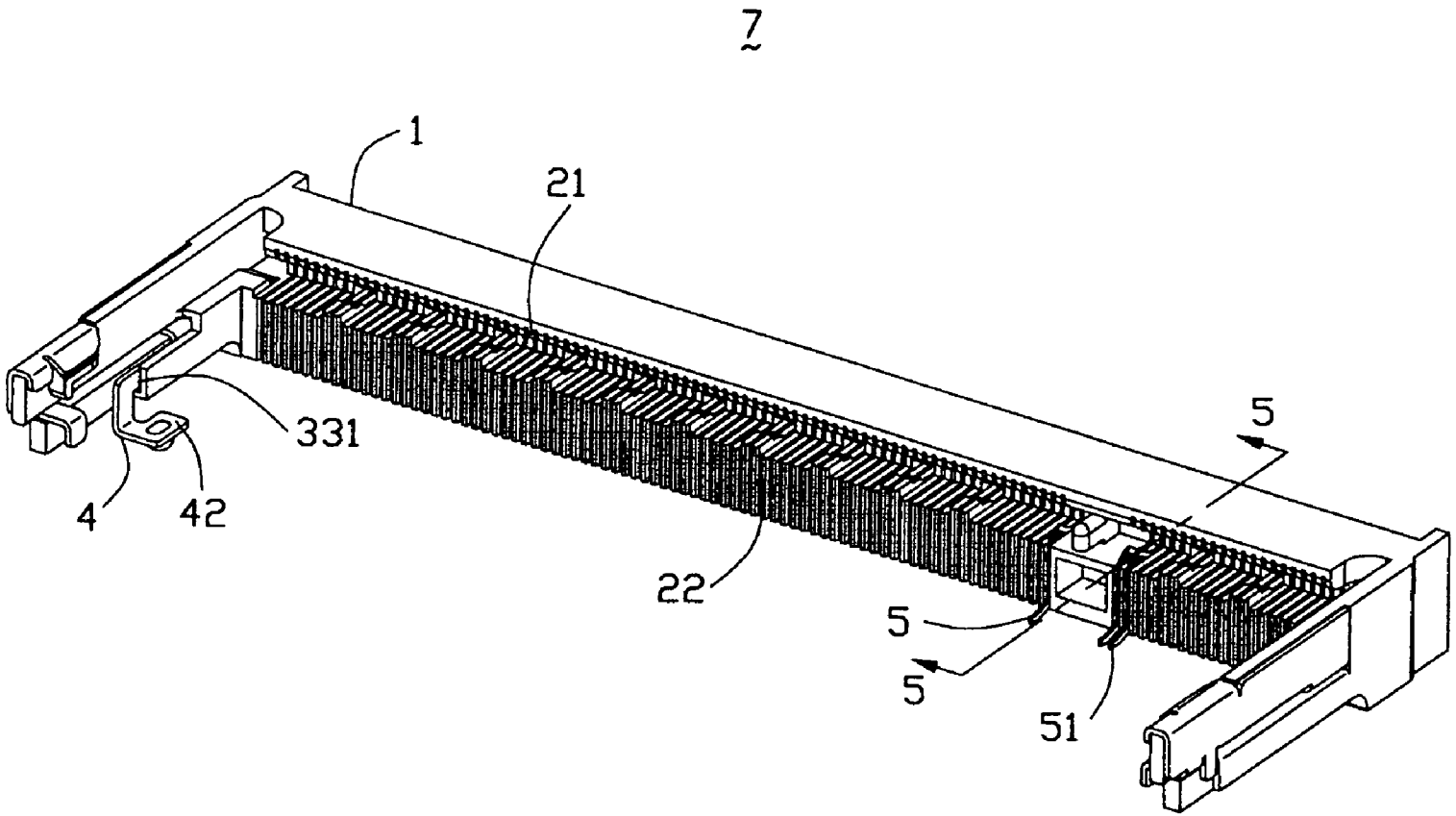
FIG. 1 is an assembled perspective view of an electrical connector in accordance with a preferred embodiment of the present invention.

References will now be made to the drawing figures to describe the preferred embodiment of the present invention in detail.

Figure 2:
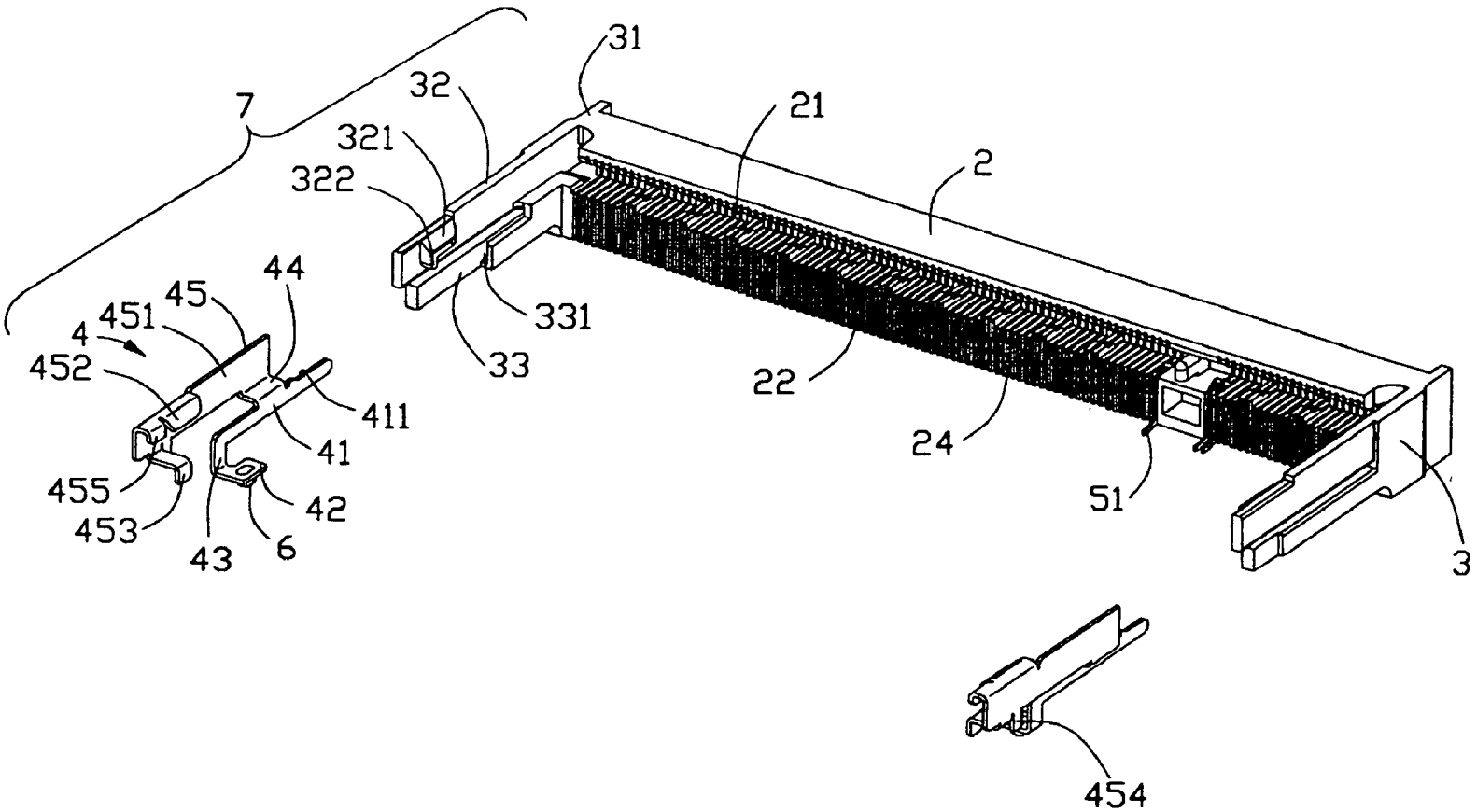
FIG. 2 is an exploded, perspective view of the electrical connector shown in FIG. 1, wherein metallic latches are detached from a housing thereof.

Referring to FIGS. 1 and 2, an electrical connector 7 for electrically and mechanically connecting an electronic card (not shown) to a printed circuit board (PCB) (not shown) in accordance with the preferred embodiment of the present invention, comprises a housing 1, a plurality of terminals 5, and a pair of metallic latches 4, wherein the housing 1 includes an elongated body 2 retaining the terminals 5 therein and a pair of cantilevered side walls 3 respectively extending from two opposite longitudinal ends of the body 2.

Figure 3:
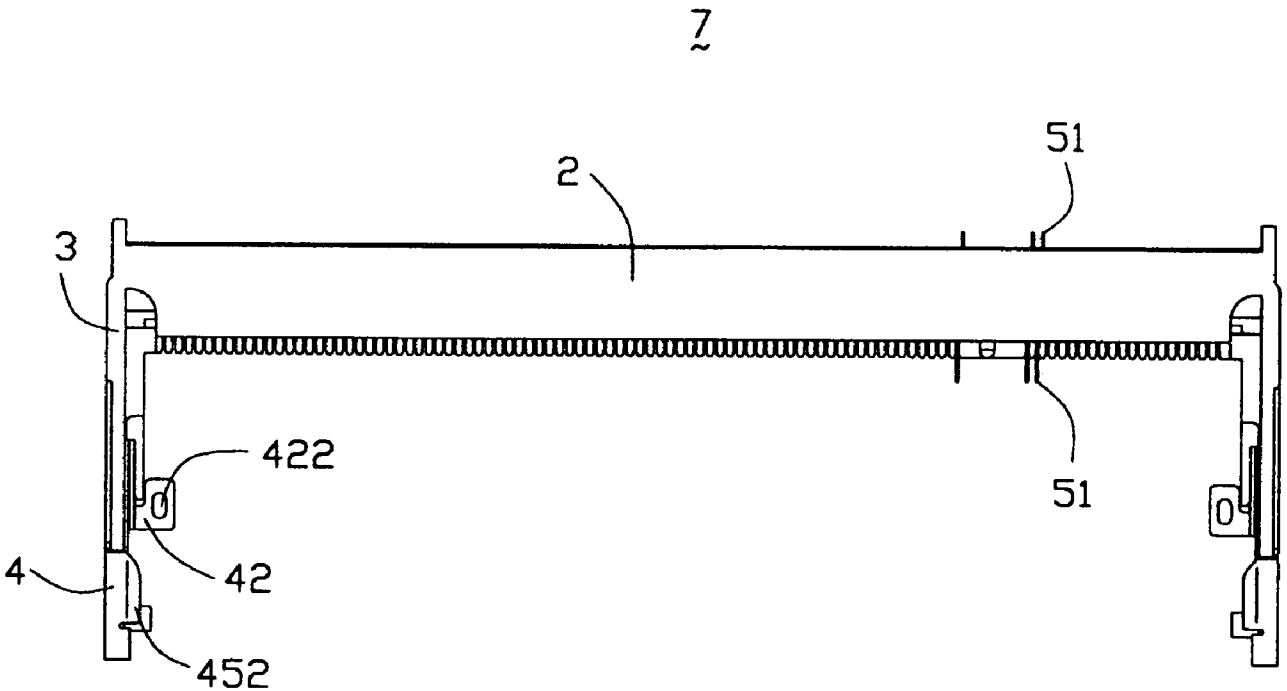
FIG. 3 is a top plan view thereof.
Figure 4:
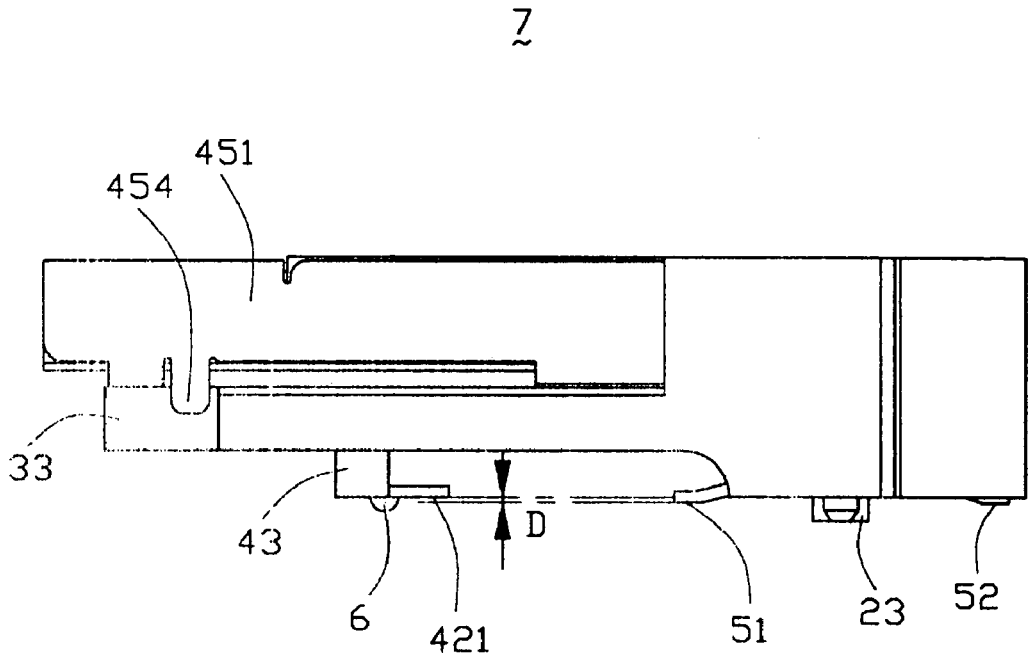
FIG. 4 is a right side elevational view thereof.
Figure 5:
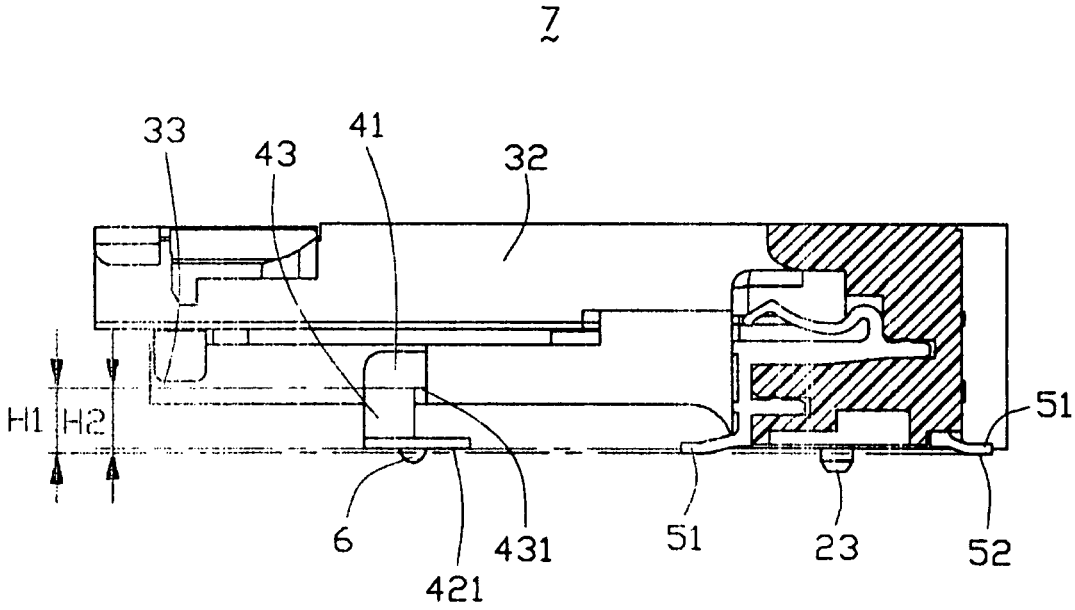
FIG. 5 is a cross-sectional view of FIG. 1 taken along line 5—5.

Referring to FIGS. 2, 4 and 5, the housing 1 made from the insulative material further includes two positioning posts 23 on the bottom of the body 2 to position the housing 1 to the PCB. The body 2 define an elongated slot 21 along the longitudinal direction thereof for retaining one end of the electronic card and a plurality of passageways 22 communicating with the slot 21. Each side wall 3 includes a first portion 32 and a second portion 33 which define a gap therebetween, wherein said first portion 32 includes a latching portion 321 and a retaining portion 322 at a free end thereof, and said second portion 33 defines a mating groove 331. As best shown in FIG. 3, the terminals 5 are respectively inserted into the passageways forwardly or rearwardly in two rows, each said terminal 5 is loaded in a corresponding passageway 22, with one end thereof extending into the slot 21, and the other end 51 thereof, called as solder tail 51, extending beyond the body 2 for mechanically and electrically connecting to the PCB, as best shown in FIG. 5. Since the two rows of terminals are assembled on the housing separately, the solder tails of terminals should be adjusted to form a common mounting plane 52 performing a wonderful coplanarity. The electronic card is inserted into the slot 21 to have conductors thereof mechanically and electrically connected to the end of the corresponding terminal 5 so as to form an electrical connection between the electronic card and the PCB.

Referring to FIGS. 1 and 2, each metallic latch 4 comprises an elongated base portion 41 with some protuberances 411 in one end thereof, a jointing portion 43 vertically extending down from the other end thereof, and a mounting portion 42 horizontally and laterally extending from the jointing portion 43, which defines a hole 422 in a center thereof and will be soldered to the PCB. The metallic latch further comprises a connecting piece 44 extending vertically from the base portion 41 between the protuberances 411 and the jointing portion 43, and a latching piece 45 extending from the connecting piece 44. The latching piece 45 includes an upright portion 451 connecting to the connecting piece 44, a guiding portion 452, a retaining portion 455, a first position piece 453 and a second piece 454. The aforementioned guiding portion, the retaining portion, the first position piece and the second position piece all are located at the distal end of the upright portion 451.

Referring to FIG. 1, in assembly, each metallic latch 4 is fastened to the side wall 3 via the base portion 41 with the protuberances 411 thereof inserted into the groove 331. The retaining portion 455 firmly catches hold of the first portion 32, and the guiding portion 452 cover a top face of the latching portion 321 for protecting the latching portion 321 from being scraped during insertion of the electronic card. The upright portion 451 tightly abuts on exterior surface of the first portion 32 for enhancing the first portion 32, while the first position piece 453 and the second piece 454 are positioned respectively at two opposite sides of the second portion 33. The aforementioned first position piece 453, second position piece 454 and second portion 33 prevent the first portion 32 from being excessively bended and broken when the first portion 32 and the upright portion 451 move associatively for releasing the electronic card.

As best shown in FIGS. 4 and 5, after assembled, the bottom plane 421 of the mounting portion parallels to the mounting plane 52 and forms a distance D therebetween. As seen, H1 is the distance between the top portion 431 of the jointing portion 43 and the mounting plane 52, and H2 is the distance between the top portion 431 of the jointing portion 43 and the bottom plane 421 of the mounting portion 42, deviation of which defines the dimension of the distance D which is about 0.005~0.1 millimeters preferably. A solder ball 6 is pre-welded to the mounting portion 42 on the bottom plane 421, and has a dimension vertically extending from the bottom plane 421 a little larger than the distance D. When the aforementioned connector with solder balls 6 is positioned to the PCB by means of positioning the positioning post 23, the connector slightly inclines up at the side of the side walls 3 (left side as shown in FIG. 4) because the dimension of the solder balls 6 is a little larger than the distance D. Since the heated solder balls 6 are optionally deformable in configuration, during surface soldering process, the slightly inclined connector becomes aclinic to make the mounting plane 52 and the bottom plane 421 of the mounting portion 42 be parallel to the PCB. Because the solder ball 6 is big enough, the distance D is filled with solder, while the excessive solder can overflow through the hole 422 of the mounting potion 42. As a result, the coplanarity of the solder tails 51 can be maintained, and the terminals 5 and the mounting portions 42 are reliably soldered to the PCB with facility.

In fact, the coplanarity of the solder tails 51 can also be maintained if the solder ball 6 extending from said bottom plane 421 is a little smaller than the distance D between said bottom plane 421 and said mounting plane 52, since the heated solder balls 6 will downwards flow to the PCB and fill the distance D, during surface soldering process. As a result, the coplanarity of the tails 51 can be maintained, and the terminals 5 and the mounting portions 42 are reliably soldered to the PCB. Likely, the solder ball 6 also can be placed above on the mounting portion 42, then during surface soldering process, the heated solder downwards flows through the holes 422 and fills the distance D, so the coplanarity of the tails 51 can be maintained.

However, the disclosure is illustrative only, changes may be made in detail, especially in matter of shape, size, and arrangement of parts within the principles of the invention.

What is claimed is:

1. An electrical connector for surface mounting on a printed circuit board (PCB) comprising:

an insulative housing;

a plurality of terminals disposed in the housing and having tails extending beyond the housing, all the tails defining a common mounting plane;

at least one metallic mounting portion assembled to the housing, said at least one metallic mounting portion defining a bottom plane for soldering to the PCB, said bottom plane being located at a level higher than said mounting plane by a distance; and a solder ball connected to the at least one metallic mounting portion, said solder ball being able to be softened to fill said distance during soldering.

2. The electrical connector as described in claim 1, wherein the solder ball extends downwardly from said bottom plane.

3. The electrical connector as described in claim 2, wherein each of the at least one metallic mounting portion defines a hole.

4. The electrical connector as described in claim 2, wherein the distance between said bottom plane and said mounting plane is about 0.05~0.1 millimeters.

5. The electrical connector as described in claim 2, wherein the dimension of the solder ball extending from said bottom is a little smaller than the distance between said bottom plane and said mounting plane.

6. The electrical connector as described in claim 2, wherein the housing defines some positioning posts on the bottom thereof.

7. The electrical connector as described in claim 2, wherein the vertical dimension of the solder ball extending from said bottom plane is a little larger than the distance between said bottom plane and said mounting plane.

8. The electrical connector as described in claim 7, wherein the housing has a body and a pair of side walls respectively extending from the opposite distal ends of the body, each said side wall have a retaining portion and a latching portion for latching a complemental element, both of which are loaded at the free end of the side wall, and said body define an elongated slot for receiving the complemental element.

9. The electrical connector as described in claim 2, wherein the housing includes grooves, and each of the at least one metallic mounting portion connects a base portion with protubearances inserted into a corresponding groove.

10. The electrical connector as described in claim 9, wherein the housing has a body and a pair of side walls respectively extending from the opposite distal ends of the body, each said side wall have a retaining portion and a latching portion for latching a complemental element, both of which are loaded at the free end of the side wall, and said body defines an elongated slot for receiving the complemental element.

11. The electrical connector as described in claim 10, wherein the base portion connects a latching piece, and said latching piece comprises an upright portion tightly abutting on the exterior of the side wall and a guiding portion matching with said latching portion.

12. The electrical connector as described in claim 11, wherein the side wall comprises a upper portion and a lower portion which define a gap therebetween, and the upright portion extends downwardly a first position piece and a second position piece which are positioned respectively at one side of said lower portion, all of which prevent the first portion from being excessively bended.

13. The electrical connector as described in claim 1, wherein the solder ball is placed above on the at least one metallic mounting portion, each of the at least one metallic mounting portion further defines a hole, and said softened solder ball flows down to the PCB through the hole.

14. The electrical connector as described in claim 13, wherein the distance between said bottom plane and said mounting plane is about 0.05~0.1 millimeters.

15. The electrical connector as described in claim 13, wherein the housing includes grooves, and each of the at least one metallic mounting portion connects a base portion with protubearances inserted into a corresponding groove.

16. The electrical connector as described in claim 15, wherein the housing has a body and a pair of side walls respectively extending from the opposite distal ends of the body, each said side wall have a retaining portion and a latching portion for latching a complemental element, both of which are loaded at the free end of the side wall, and said body define an elongated slot for receiving the complemental element.

17. The electrical connector as described in claim 16, wherein the base portion connects a latching piece, and said latching piece comprises an upright portion tightly abutting on the exterior of the side wall and a guiding portion matching with said latching portion.

18. The electrical connector as described in claim 17, wherein the side wall comprises a upper portion and a lower portion which define a gap therebetween, and the upright portion extends downwardly a first position piece and a second position piece which are positioned respectively at one side of said lower portion, all of which prevent the first portion from being excessively bended.

19. An electrical connector comprising:

an insulative housing defining a mating port for receiving a complementary electronic part;

a plurality of terminals disposed in the housing, each of said terminals defining a surface-mount tail section extending beyond the insulating housing and horizontally and having thereof a bottom surface defining a first plane;

a metallic part assembled to the housing and having a mounting portion extending horizontally and having thereof a bottom face defining a second plane; and a solder ball located below and attached to said bottom face and defining an outermost point thereof; wherein the first plane is located between the second plane and the outermost point in a vertical direction.

20. An electrical connector comprising:

an insulative housing defining a mating port for receiving a complementary electronic part, and further having thereof a mounting surface defining a first plane for directly mounting to a printed circuit board on which said housing is seated;

a plurality of terminals disposed in the housing, each of said terminals defining a surface-mount tail section extending beyond the insulating housing and horizontally and having thereof a bottom surface in the first plane; a metallic part assembled to the housing and having a mounting portion extending horizontally and having thereof a bottom face defining a second plane; and a solder ball located below and attached to said bottom face and defining an outermost point thereof; wherein the first plane is located between the second plane and the outermost point in a vertical direction.

* * * * *